US009483893B2

(12) United States Patent
Bullock et al.

(10) Patent No.: US 9,483,893 B2
(45) Date of Patent: Nov. 1, 2016

(54) SECURABLE BANKNOTE CARRIER, AND A BANKNOTE HANDLING APPARATUS AND BANKNOTE CASSETTE FOR USE WITH THE SECURABLE BANKNOTE CARRIER

(71) Applicant: Innovative Technology Limited, Oldham (GB)

(72) Inventors: Andrew Bullock, Oldham (GB); John Robinson, Oldham (GB)

(73) Assignee: Innovative Technology Limited, Oldham (GB)

( * ) Notice: Subject to any disclaimer, the term of this patent is extended or adjusted under 35 U.S.C. 154(b) by 0 days.

(21) Appl. No.: 14/480,665

(22) Filed: Sep. 9, 2014

(65) Prior Publication Data

US 2015/0083792 A1 Mar. 26, 2015

(30) Foreign Application Priority Data

Sep. 25, 2013 (GB) ..... 1317013.9

(51) Int. Cl.
*G07D 11/00* (2006.01)

(52) U.S. Cl.
CPC ..... *G07D 11/0009* (2013.01)

(58) Field of Classification Search
CPC ..... G07D 11/0009; G07D 11/0006; G07D 11/0012; G07F 9/06; G07F 19/202; G07F 19/203; B65H 2701/1912; B65D 33/16; A45C 13/06
USPC ..... 232/1 D, 15, 16, 43.2; 109/45, 52, 59 R, 109/66; 194/350; 902/13; 383/34; 150/120, 150/123
See application file for complete search history.

(56) References Cited

U.S. PATENT DOCUMENTS

| | | | | |
|---|---|---|---|---|
| 2,670,020 | A * | 2/1954 | Hammesfahr | A45C 13/06 150/123 |
| 3,060,986 | A * | 10/1962 | Rothman | A45C 13/06 150/120 |
| 3,455,369 | A * | 7/1969 | Craig | B22D 11/047 164/440 |
| 5,209,395 | A * | 5/1993 | Zouzoulas | G07D 11/0009 109/45 |
| 5,611,483 | A * | 3/1997 | Sciortino | G07F 9/06 232/15 |
| 5,662,202 | A | 9/1997 | Suris | |
| 5,850,966 | A * | 12/1998 | Siler | G07F 9/06 109/46 |
| 8,584,603 | B2 * | 11/2013 | Villiger | G07D 11/0006 109/22 |
| 2002/0056960 | A1 | 5/2002 | Bergeron et al. | |
| 2007/0145064 | A1 | 6/2007 | Clauser et al. | |
| 2008/0073177 | A1 * | 3/2008 | Hansson | G07D 11/009 194/344 |
| 2009/0090443 | A1 * | 4/2009 | Preciado | A45C 5/065 150/113 |

(Continued)

FOREIGN PATENT DOCUMENTS

| | | |
|---|---|---|
| EP | 1966069 | 3/2013 |
| GB | 2437677 | 10/2007 |

(Continued)

*Primary Examiner* — William Miller
(74) *Attorney, Agent, or Firm* — Woodard, Emhardt, Moriarty, McNett & Henry LLP

(57) ABSTRACT

A securable banknote carrier comprising an enclosure of flexible material attached to an articulated bi-fold frame delimiting a banknote aperture, wherein the frame comprises a pair of hingedly coupled opposing jaw members, and wherein the frame is configured such that when moving from a banknote aperture open position to a banknote aperture closed position the opposing jaw members rotate inwardly towards one another from a position in which the jaw members are substantially coplanar to a position m which the members are substantial adjacent and parallel to each other.

13 Claims, 9 Drawing Sheets

(56) References Cited

U.S. PATENT DOCUMENTS

2011/0266114 A1* 11/2011 Chen ..... G07D 11/0009 194/206
2012/0047854 A1* 3/2012 Wright ..... E05G 1/005 53/476
2014/0165887 A1* 6/2014 Bane ..... E05G 1/026 109/64

FOREIGN PATENT DOCUMENTS

GB 2455558 3/2013
WO WO 2012/061851 5/2012

* cited by examiner

SECURABLE BANKNOTE CARRIER, AND A BANKNOTE HANDLING APPARATUS AND BANKNOTE CASSETTE FOR USE WITH THE SECURABLE BANKNOTE CARRIER

REFERENCE TO RELATED APPLICATIONS

This application claims priority of Great Britain Application No. 1317013.9, filed Sep. 25, 2013, the disclosure of which is incorporated herein by reference in their entirety.

BACKGROUND OF THE INVENTION

1. Field of the Invention

The present invention generally relates to securable containers for valuable items. In particular, the present invention relates to secure cash-in-transit bags for the transportation of banknotes and currency.

2. Description Of Related Art

Many conventional cash-in-transit bags are known, for example EP-B-1,966,069 discloses a secure cash-in-transit bag for installation in a lockable cassette that is removably fitted to a banknote validator. The cash-in-transit bag comprises an aperture plate to which an expandable bag is attached, and banknotes are pushed through an aperture opening in the aperture plate by operation of a stacker assembly pusher plate.

The bag disclosed in EP-B-1,966,069 contains a subassembly that is attached, via elastic members, to both the aperture plate and an inelastic strap member. Successive banknotes are inserted into the bag causing the subassembly to move away from the aperture plate into the cavity of the bag. During operation, a portion of the strap member including an aperture section is aligned with the aperture of the aperture plate allowing banknotes to be inserted. Removal of the cash-in-transit bag from the cassette can only be achieved once the strap member has been pulled to an extended locking position where the aperture of the aperture plate is closed by a sealing portion of the strap member. At this juncture, the only way to access the contents of the bag is by cutting it open or by tampering with the now sealed aperture.

Another conventional tamper-evident cash-in-transit bag is described in GB-B-2,455,558. Here, a plastic bag spans and is attached to a frame. The frame includes lateral channels for slidably receiving a cover plate. The cover plate includes a toothed tongue that meshes with corresponding projections in the frame to form an irreversible lock. The cover plate includes an additional locking part that traps a portion of the bag when the cover plate is in the locked position, and it also includes frangible parts that break easily under pressure.

A problem arises with conventional cash-in-transit bags in that closure of the bags requires separate activation of a subassembly member or locking device. The prior art discussed above involves a complex construction of numerous parts with a commensurately high manufacturing cost. Furthermore, the more complex a device is the higher likelihood there is of malfunction or failure.

The present invention attempts to address some or all of the problems associated with the prior art.

BRIEF SUMMARY OF THE INVENTION

According to an aspect of the present invention there is provided a securable banknote carrier as defined in claim 1.

Advantageously, the opposing jaw members are coupled together via a pair of live coaxial hinges which jointly bias the jaw members to rotate towards one another about this common axis. This bias is only slight and is overridden when the banknote carrier is secured in place within a banknote cassette.

Preferably, the articulated bi-fold frame includes locking means for irreversibly locking the opposing jaw members together in the banknote aperture closed position. The locking means comprises at least one male barb means disposed on one of the pair of opposing jaw members and at least one corresponding female engaging means disposed on the other jaw member and adapted to receive the at least one male barb means. Advantageously, once mated, the male barb means and the female engaging means cannot be disengaged without destruction or rupture of one of the male barb means or the female engaging means. Consequentially, the locking means cannot be opened without it being evidenced by broken male and/or female means.

Each of the jaw members preferably includes a skirt portion projecting orthogonally from an underside surface, to which the enclosure of flexible material is attached by sonic welding, heat welding, or by the application of an adhesive. The enclosure of flexible material comprises a foldable or compressible bag fabricated from low density polyethylene, linear low density polypropylene or polybutene-1.

Preferably, the articulated bi-fold frame is fabricated from polypropylene or acrylonitrile butadiene styrene, and the frame may include identifying indicia such as a barcode or the like. Alternatively, or in addition, the frame can include a radio-frequency identification (RFID) tag.

Advantageously, the presence of a barcode or an RFID tag or other such device enables a proximal sensor or reader to continually monitor for the presence of a securable banknote carrier. Alternatively or in addition, the presence of a securable banknote carrier can be monitored by an optical sensor.

Preferably, the articulated bi-fold frame includes longitudinal axial lugs for engagement with corresponding mounting brackets on a banknote cassette, and each of the pair of opposing jaw members includes a laterally disposed channel on the underside surface for engagement with a respective one of a corresponding pair of banknote cassette gate members.

According to another aspect of the present invention there is provided a banknote cassette as defined in claim 9.

The banknote cassette is adapted to removably include a securable banknote carrier as previously defined, and in operation the resiliently biased stacker plate of the banknote cassette is urged against expansion of the enclosure of flexible material.

Preferably, the banknote cassette includes one or more mounting brackets positioned proximal to the aperture for receiving the securable banknote carrier. The cassette further includes a mounting bracket releasing mechanism configured to reciprocate the mounting bracket between an open and a closed position.

According to a further aspect of the present invention there is provided a banknote handling apparatus as defined in claim 11.

Preferably, each of the pair of banknote cassette gate members is resiliently biased in a substantially closed position, and they are interconnected such that each of the pair of banknote cassette gate members is configured to open and close in unison with the other.

Advantageously, insertion of the banknote cassette containing a banknote carrier into the apparatus urges the pair of banknote cassette gate members away from the advancing cassette into a substantially open position, and wherein upon retraction of the banknote cassette said banknote cassette gate members initially resile to cooperatively engage with the laterally disposed channels of the bi-fold frame opposing jaw members and, upon further retraction of the banknote cassette, continue to resile to a closed position simultaneously folding the bi-fold frame into a banknote aperture closed position such that opposing jaw members interlock via action of the locking means.

Preferably, the stacker mechanism comprises a motor driven banknote transport and a pusher plate device, and the pusher plate device includes a plate member connected to a scissor arrangement configured to move said plate member in a reciprocating manner.

The banknote receiving and bagging apparatus may include a banknote validator from which banknotes are received, and the stacker mechanism is preferably powered and driven by the banknote validator.

An embodiment of the present invention will now be described, by way of example only, with reference to the accompanying schematic drawings, in which:

DETAILED DESCRIPTION OF THE INVENTION

Figure 1:
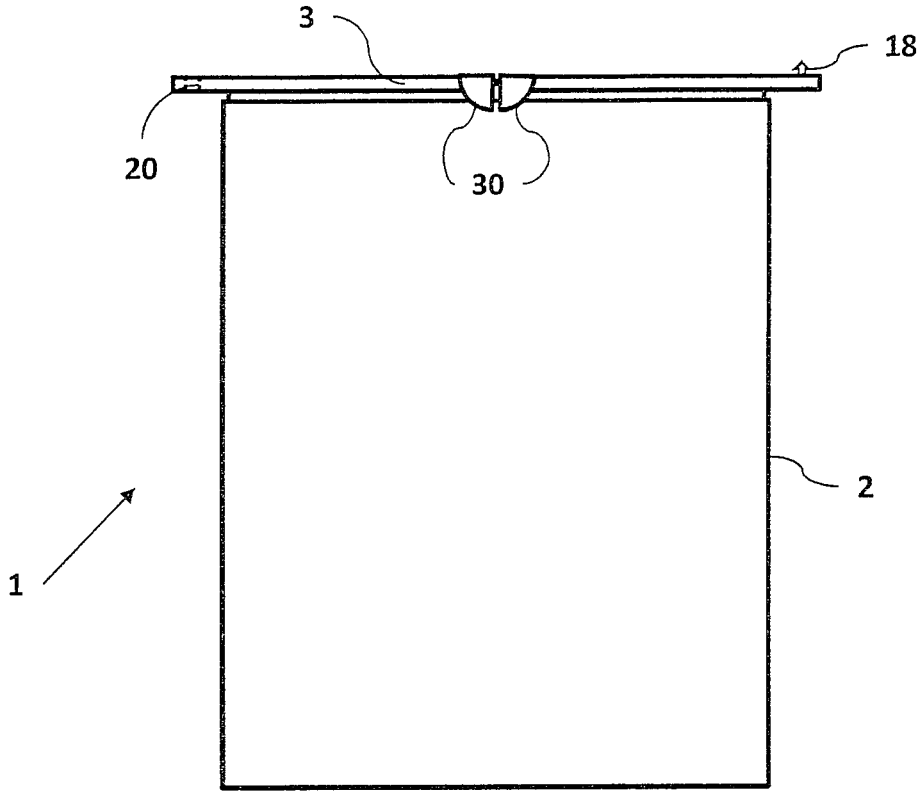
FIG. 1 shows an elevation view of a secure banknote carrier of the present invention when in a fully extended condition.
Figure 2:
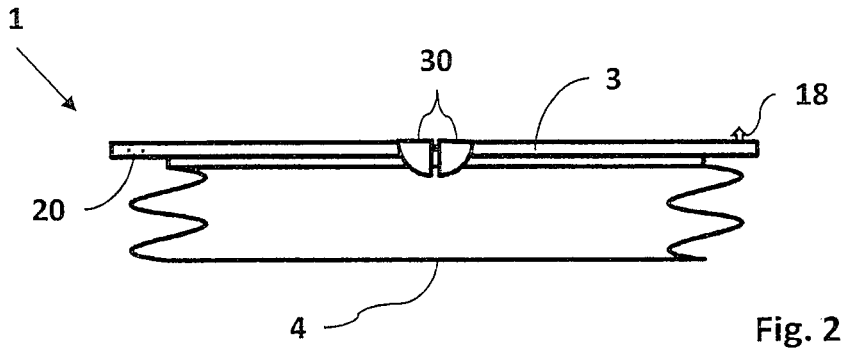
FIG. 2 shows the secure banknote carrier of FIG. 1 in a collapsed condition.

With reference to FIG. 1, a securable banknote carrier 1 comprises an enclosure of flexible material 2 attached to an articulated bi-fold frame 3. As shown in FIG. 2, the enclosure of flexible material 2 is preferably a foldable and/or compressible bag 4 which can expand and extend away from the articulated bi-fold frame 3 as the contents held within increases. Typically, the contents of the bag 4 will be paper currency banknotes. However, it is envisaged that the bag 4 is suitable for receiving and storing any other type of valuable document, for example coupons, vouchers or barcoded tickets.

The bag 4 may be fabricated from paper, cloth, fabric or a plastics material, and in a preferred embodiment the bag 4 is made from low density polyethylene, linear low density polypropylene or polybutene-1. For clarity, and to assist in describing the articulated bi-fold frame 3, the bag 4 is not shown in FIGS. 3A to 3C.

Although not shown in the Figures, the bag 4 may include a plurality of perforations or holes that allow an ink or dye to permeate into the body of the bag in the event of a security alert triggering the dispersal of an ink or dye in the vicinity of the bag such that the bag's contents become coated with the ink or dye. In an alternative embodiment, the bag is made from an ink-permeable cloth, fabric or mesh.

With reference to FIGS. 1 to 3D, and FIG. 5, the articulated bi-fold frame 3 comprises a pair of opposing jaw members 10 interconnected by two live hinges 12 positioned at opposite ends of the longitudinal axis of the articulated bi-fold frame 3. Each live hinge 12 is a flexure bearing formed from a thin section of the articulated bi-fold frame 3 between each of the jaw members 10.

The articulated bi-fold frame 3 is fabricated from polypropylene or acrylonitrile butadiene styrene, although it is envisaged that any suitable plastics material may be employed.

Figure 5:
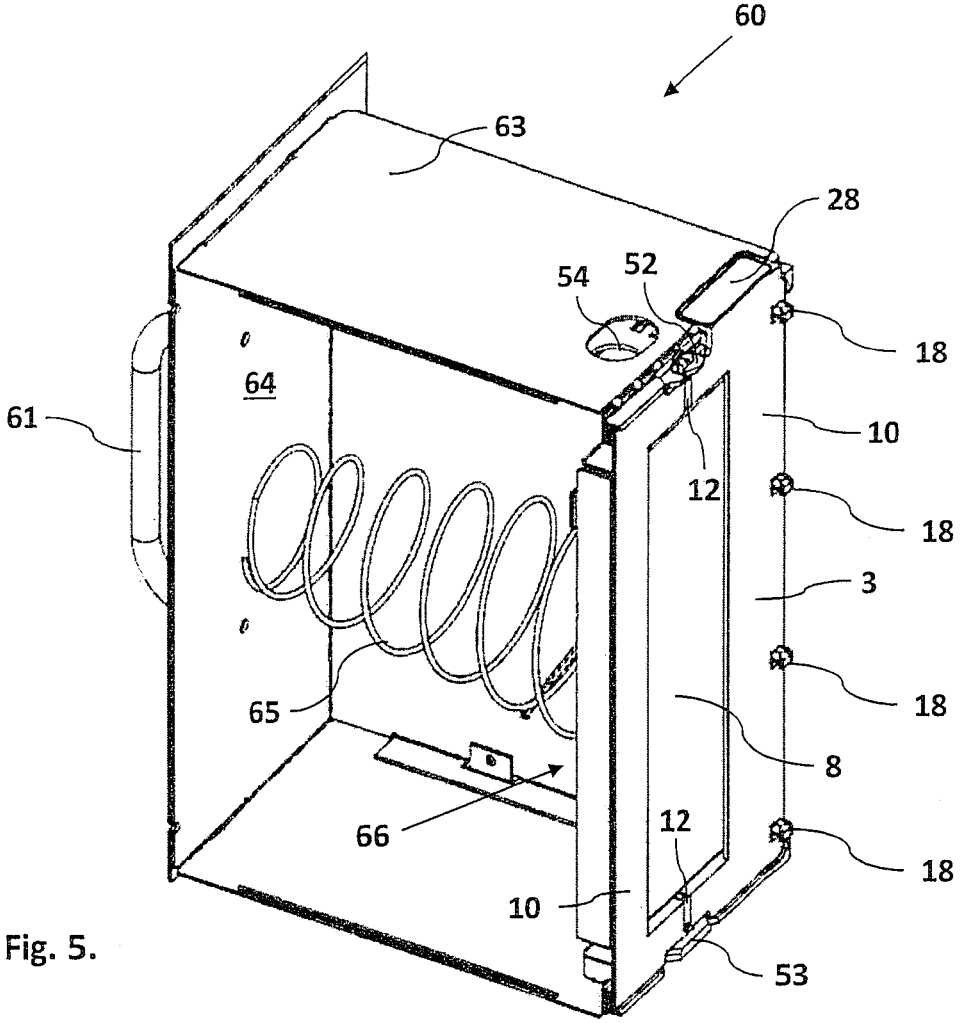
FIG. 5 is an isometric projection of a banknote cassette of the present invention.

Each jaw member 10 includes a pair of opposing axial lugs 30 positioned adjacent to the live hinges 12, and each axial lug 30 is configured to be releasably received by corresponding banknote cassette mounting brackets 52, 53 (see FIG. 5). The mounting brackets 52, 53 are disposed opposite one another at coaxial longitudinal positions adjacent to an opening in a banknote cassette 60.

As shown in FIGS. 3A to 3D, each of the jaw members 10 of the articulated bi-fold frame 3 include a skirt portion 22 projecting orthogonally downwards away from the underside 24 of the frame 3. Each skirt portion 22 forms a three-sided C-shaped protuberance surrounding a banknote aperture 8 and to which the bag 4 is attached. Attachment of the bag 4 to the skirt portion 22 is secured by sonic welding, heat welding, the application of an adhesive, or any other such suitable method known in the art for securing a bag 4 to such a protuberance.

Figure 3A:
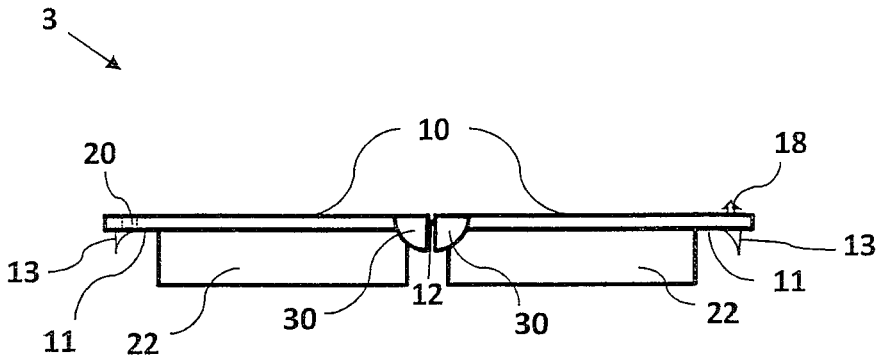
FIGS. 3A to 3C show elevation views of the frame of the banknote carrier in various operational stages.
Figure 3B:
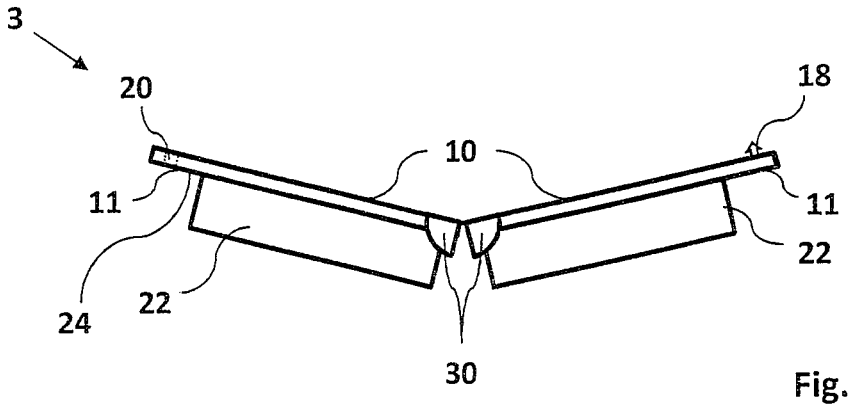
Figure 3C:
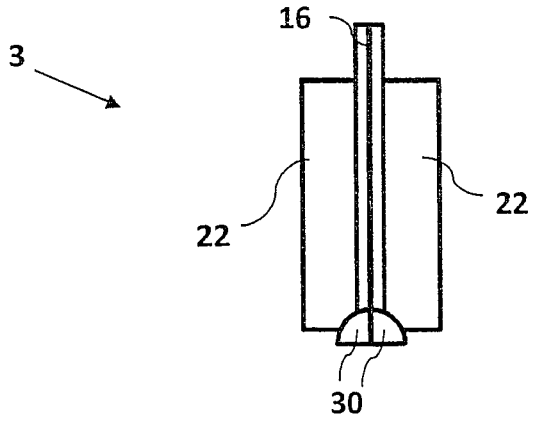
Figure 3D:
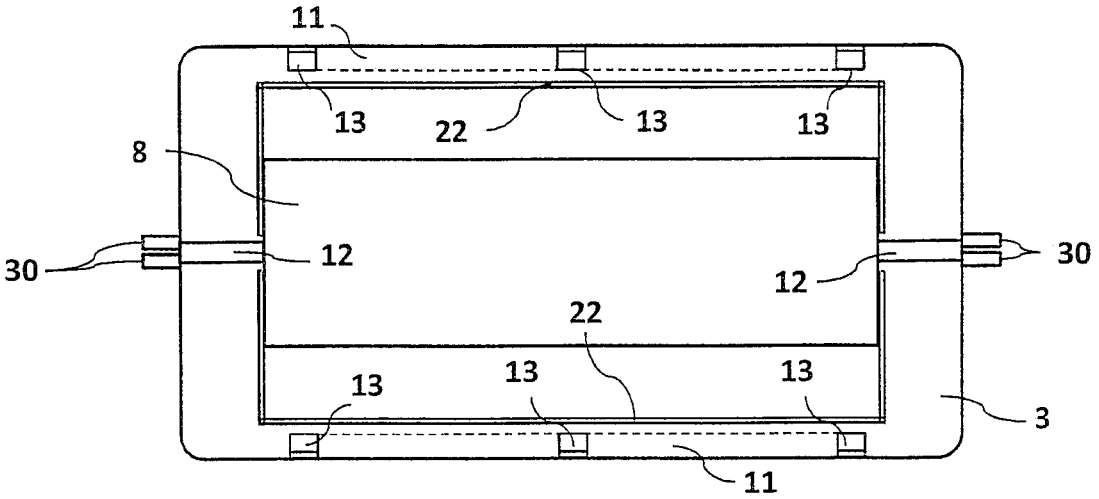
FIG. 3D is an underside plan view of the banknote carrier frame.

As shown in FIGS. 3A and 3D, the underside of the articulated bi-fold frame 3 includes a pair of parallel engagement channels 11 formed by three collinear channel guide members 13. Each channel guide member 13 comprises a substantially L-shaped projection including an arcuate shoulder facing inwardly towards the skirt portion 22.

FIGS. 3A to 3C illustrate various stages of a closing operation of the articulated bi-fold frame 3. In FIG. 3A the articulated bi-fold frame 3 is in a fully open position. In FIG. 3B the articulated bi-fold frame 3 is a partially closed position, and in FIG. 3*c* the articulated bi-fold frame 3 is shown in a fully closed position.

The articulated bi-fold frame 3 includes locking means 16 comprising a plurality of male barb means 18 arranged collinearly in a longitudinally direction along a peripheral portion of the right-hand side jaw member 10 (as viewed in FIG. 5). The frame 3 also includes a plurality of female engaging means 20 arranged on the opposite left-hand side jaw member 10 (not shown in FIG. 5) arranged to irreversibly mate and interlock with the corresponding plurality of male barb means 18.

Each of the male barb means 18 comprises an arrowhead projection and an adjacent shield projection. The arrowhead projections protrude outwardly from the upper surface of the right-hand side jaw member 10 (see FIG. 5). The female engaging means 20 comprises a T-shaped opening communicating with an inverted frustum-shaped recess. The T-shaped opening includes an upper lip for abutment with backwardly facing barb portions of the arrowhead projections. The shield projections provide a cover for a lateral opening in each of the recesses (not shown) such that when the articulated bi-fold frame 3 is in a closed position (see FIG. 3C) the arrowheads locked within the recesses cannot be directly tampered with.

Alternatively, in embodiments in which the recesses do not include a lateral opening, the male barb means are not required to include shield projections.

In the fully closed position shown in FIG. 3C, the locking means 16 is fully engaged and separation of the opposing jaw members 10 is no longer possible without rupturing the arrowhead projections and/or the inverted frustum-shaped recesses. In this way, once locked, the articulated bi-fold frame 3 advantageously includes a clear tamper-evident element providing a security feature of the securable banknote carrier of the present invention.

Referring to FIG. 5, a banknote cassette 60 comprises an outer casing 63 and a handle 61 mounted on a front wall 64 of the casing 63. A side wall of the casing 63 has been removed from the banknote cassette 60 shown in FIG. 5 to expose spring 65 which biases a stacker plate 66 (not shown) in a direction rearward from the front wall 64 towards a rear opening of the banknote cassette 60. The rear opening is covered in FIG. 5 by the articulated bi-fold frame 3.

The banknote cassette 60 includes a pair of opposing mounting brackets 52, 53 which are centrally positioned above and below the rear opening of the banknote cassette 60. The mounting brackets 52, 53 are adapted to receive the axial lugs 30 of the articulated bi-fold frame 3. The upper mounting bracket 52 is a spring-loaded clasp arrangement operated via mounting bracket release mechanism 54.

Figure 9A:
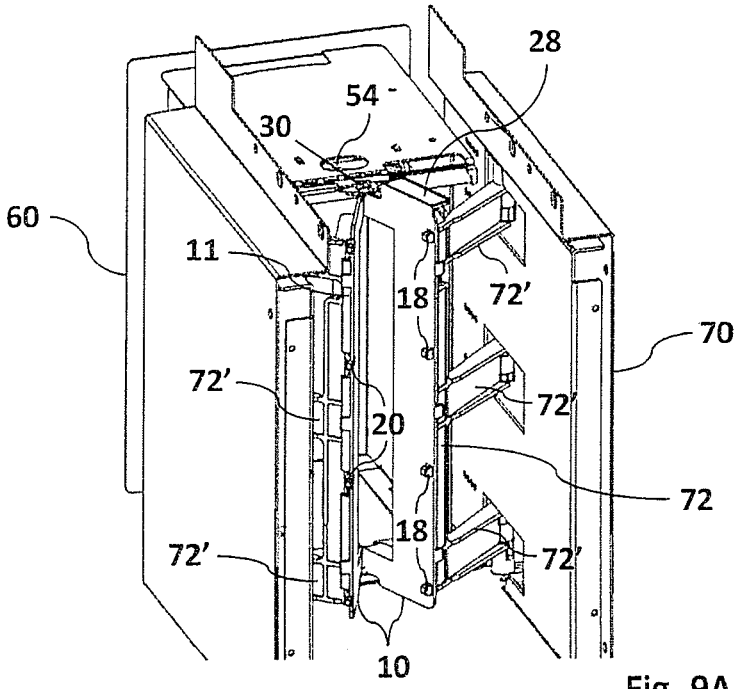
FIGS. 9A and 9B show partial sectional projections of two stages of a banknote cassette retraction from a cassette docking station.
Figure 9B:
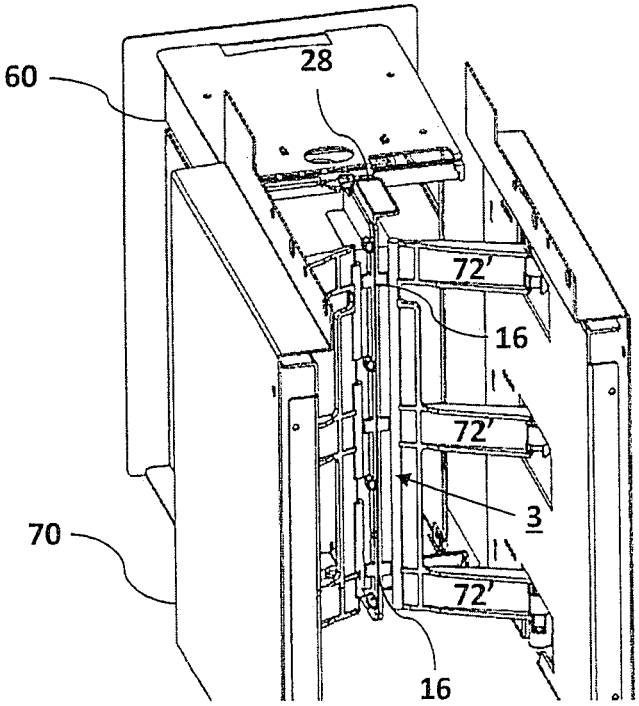

As shown in FIGS. 5, 9A and 9B, the articulated bi-fold frame 3 includes an identifying indicia mount 28. In preferred embodiment of the present invention a barcode or other such security indicia is printed on or affixed to the mount 28. In this way, each securable banknote carrier 1 is uniquely identifiable by scanning and reading the attached barcode. Alternatively, the securable banknote carrier 1 can be identified by an RFID tag attached to the articulated bi-fold frame 3. In either case the presence of a securable banknote carrier 1 within the banknote cassette 60 can be monitored by continual reading or polling of the barcode or RFID tag respectively. Such monitoring can be achieved by the inclusion of a suitable reader or sensor disposed in the banknote cassette 60 proximal to the inserted position of the bi-fold frame 3. In other embodiments the presence of the carrier is monitored by an optical sensor arrangement.

Figure 10:
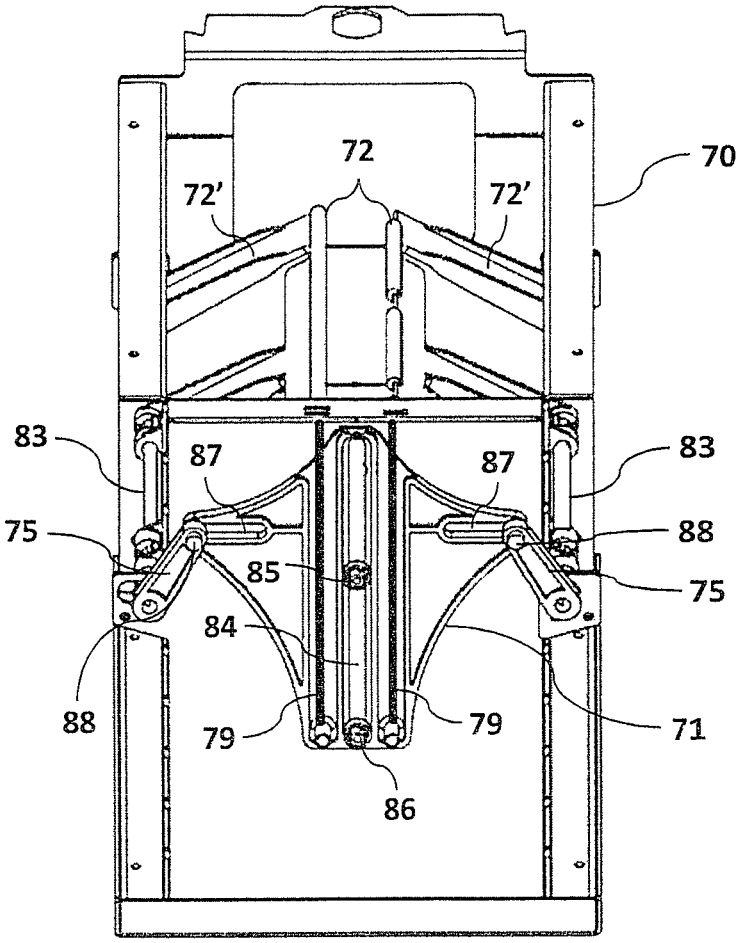
FIG. 10 is a perspective underside view of a cassette docking station of the present invention.

As shown in FIG. 10, a cassette docking station 70 comprises an articulated reciprocating carriage 71 housed within an underside compartment of the cassette docking station 70. The articulated reciprocating carriage 71 includes lever arms 75 connected to respective gate rotation shafts 83, and each lever arm 75 includes a lever arm slot 87 and a lever arm pivot point 88.

The articulated reciprocating carriage 71 also includes a carriage slot 84 and a pair of springs 79 interconnecting the carriage 71 with an outer section of the cassette docking station 70. An upper guide pin 85 and a lower guide pin 86 pass through the carriage slot 84 and are affixed to a wall of the underside compartment of the cassette docking station 70. Reciprocating movement of the carriage 71 is trammelled by the relative positions of the upper and lower guide pins 85, 86, and lateral movement of the carriage is limited by the width of the carriage slot which is in sliding abutment with upper portions of the guide pins.

With reference to FIGS. 9A and 9B, each resiliently biased gate member 72 includes three individual gate arms 72' which extend laterally through window sections in opposing outer walls of the cassette docking station 70. Each gate arm 72' is pivotally attached to a gate rotation shaft 83 running along the exterior periphery of the cassette docking station 70 in a direction parallel with the longitudinal axis (see FIG. 10).

As shown in FIG. 10, when the cassette docking station 70 is arranged to receive the banknote cassette 60, the gate members 72 are biased in a forward position with the lower guide pin 86 constraining further forward movement of the gate members 72. Insertion of a banknote cassette 60 into the cassette docking station 70 causes the gate members 72 to be pushed backwards and inwardly against the action of the springs 79 to an extent that is limited by the position of the upper guide pin 85.

Installation of a securable banknote carrier 1 within a banknote cassette 60 is achieved by a user activating the mounting bracket release mechanism 54 to open the spring-loaded clasp arrangement, inserting one of the pairs of axial lugs 30 into the lower mounting bracket 53, positioning the other pair of axial lugs 30 within the open upper mounting bracket 52, and locking the upper mounting bracket 52 by releasing the mounting bracket release mechanism 54.

Figure 4A:
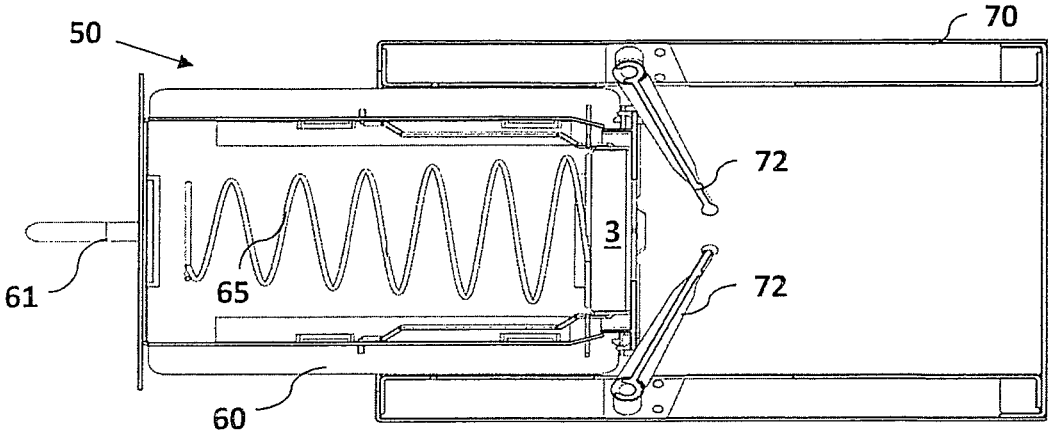
FIGS. 4A to 4C show sectional plan views of a banknote cassette of the present invention at various stages of insertion within a cassette docking station.
Figure 4B:
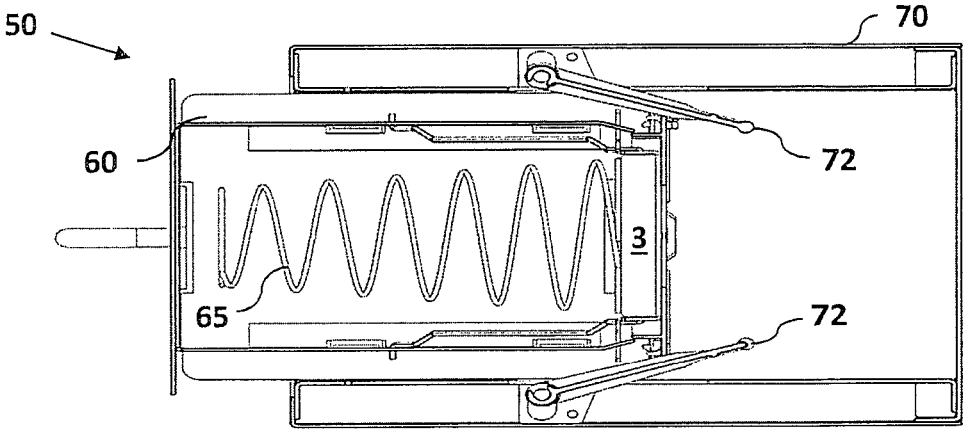
Figure 4C:
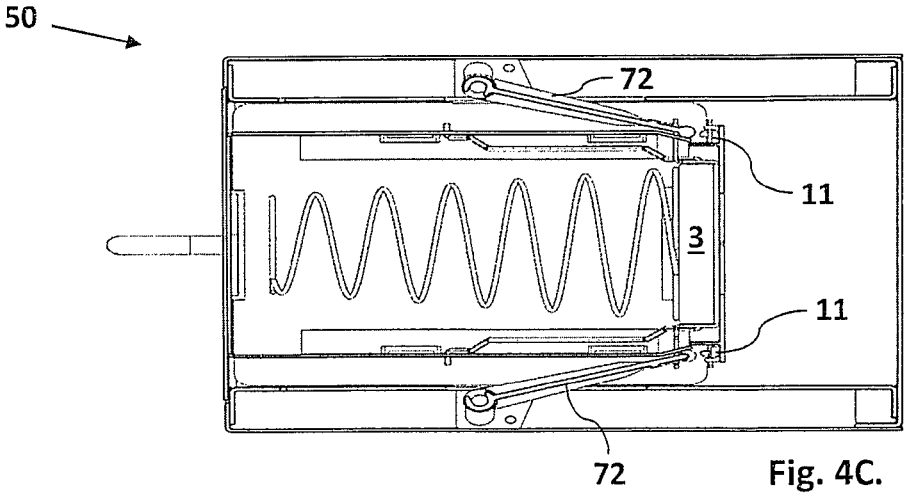

With reference to FIGS. 4A to 4C, a banknote cassette 60 containing an empty securable banknote carrier 1 is inserted into a cassette docking station 70 to form a banknote handling apparatus 50. As the banknote cassette 60 is inserted into the cassette docking station 70 an end of the cassette including the articulated bi-fold frame 3 engages with a pair of resiliently biased gate members 72. As the banknote cassette 60 is inserted further into the cassette docking station 70 the resiliently biased gate members swing away from the advancing banknote cassette 60 until they reach the position shown in FIG. 4C. At this point the banknote cassette 60 is fully inserted within the cassette docking station 70, and the ends of each of the resiliently biased gate members proximal to the articulated bi-fold frame 3 are positioned adjacent to a respective engagement channel 11 disposed on an under surface of the articulated bi-fold frame 3. It should be noted that the top cover of both the banknote cassette 60 and the cassette docking station 70 have been removed from FIGS. 4A to 4C to reveal the respective positions of the articulated bi-fold frame 3, the engagement channels 11, and the spring 65. It should also be noted that the foldable/compressible bag 4 is not shown in FIGS. 4A to 5.

Figure 11A:
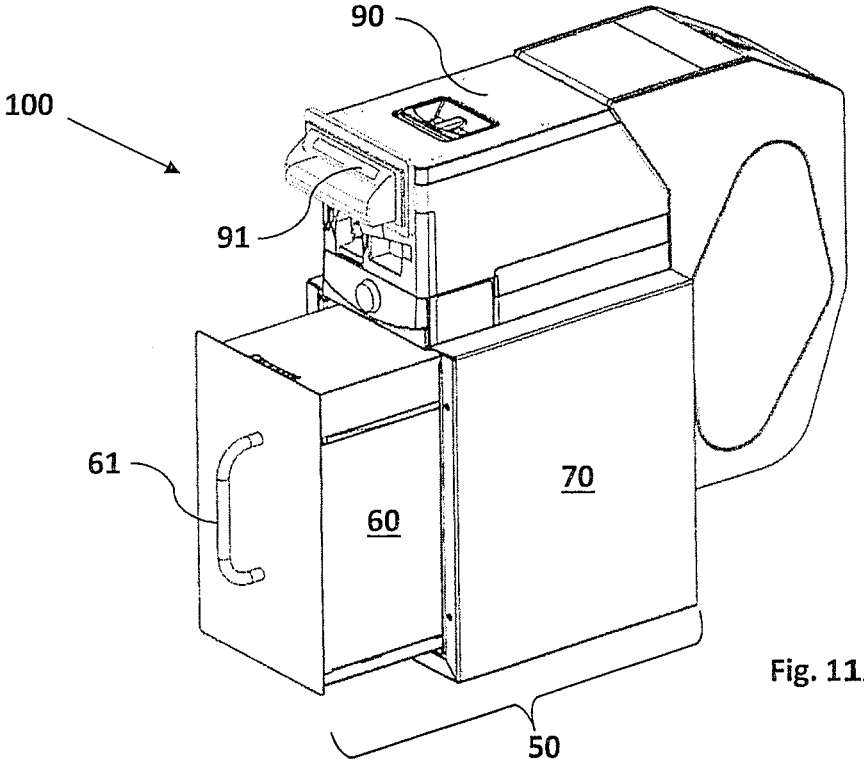
FIGS. 11A and 11B show perspective views of a banknote validation and bagging system.
Figure 11B:
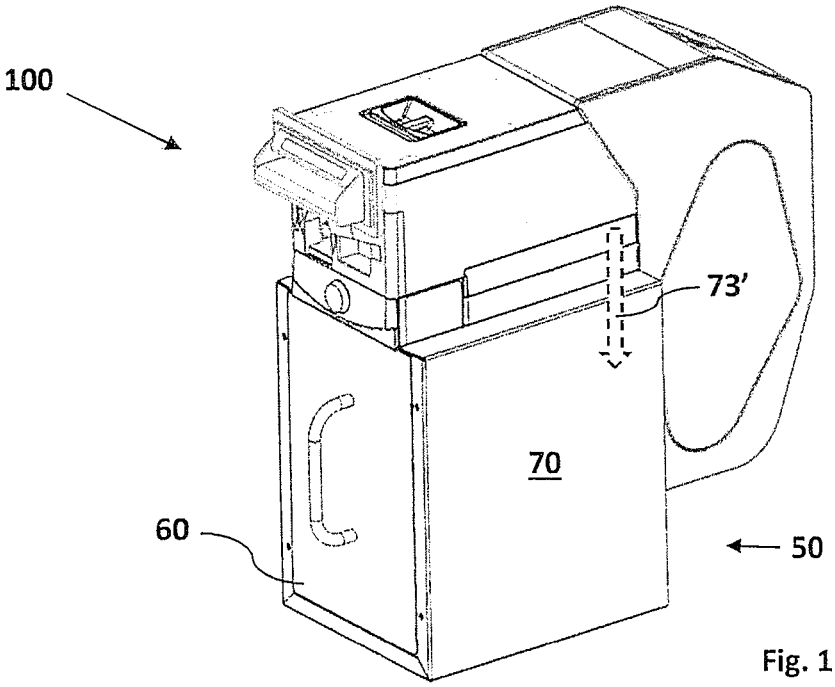

Once fully inserted within the cassette docking station 70, the banknote cassette 60 is then in a position to receive banknotes from, for example, an associated banknote validator (see FIGS. 11A and 11B). The fully inserted position will typically be verified and monitored by a suitable optical sensor arrangement known in the art.

Figure 6:
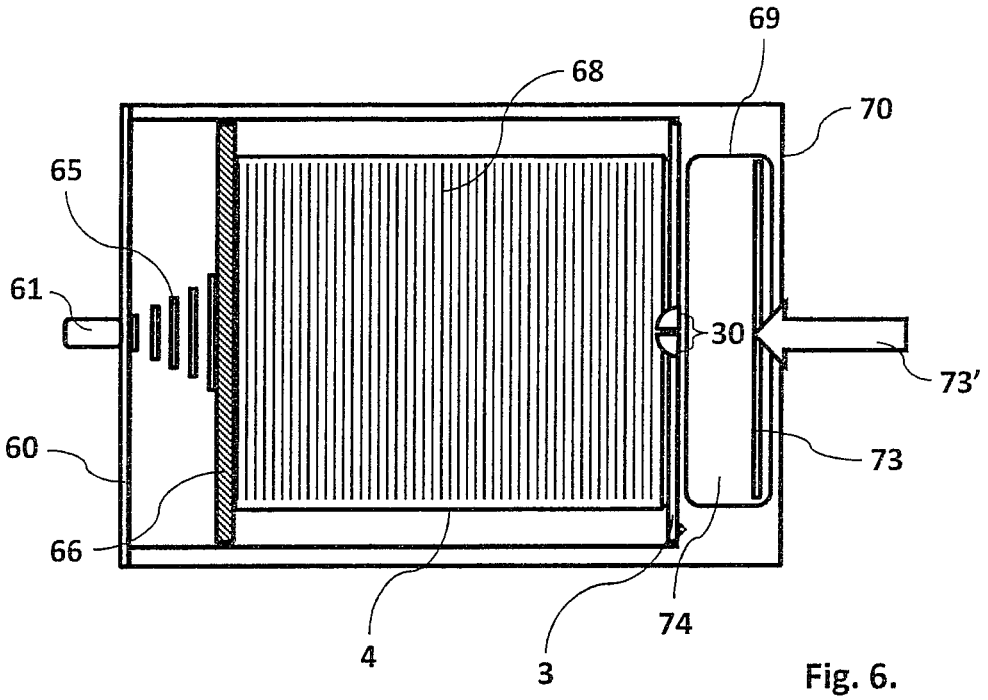
FIG. 6 shows a sectional plan view of the cassette docking station including a banknote cassette.

With reference to FIG. 6, banknotes are successively inserted and stored within the foldable/compressible bag 4 to form a banknote stack 68. Individual authenticated banknotes are received 73' from the banknote validator 90

(see FIG. 11B) and directed into the input path 73 of a stacker mechanism 69. As successive banknotes are added to the banknote stack 68, the bag 4 extends away from the articulated bi-fold frame 3 against the biasing pressure exerted via a spring 65 and a stacker plate 66. In this way, the banknote stack 68 increases in a controlled manner, and a uniform 'stacked' orientation is maintained.

Figure 7:
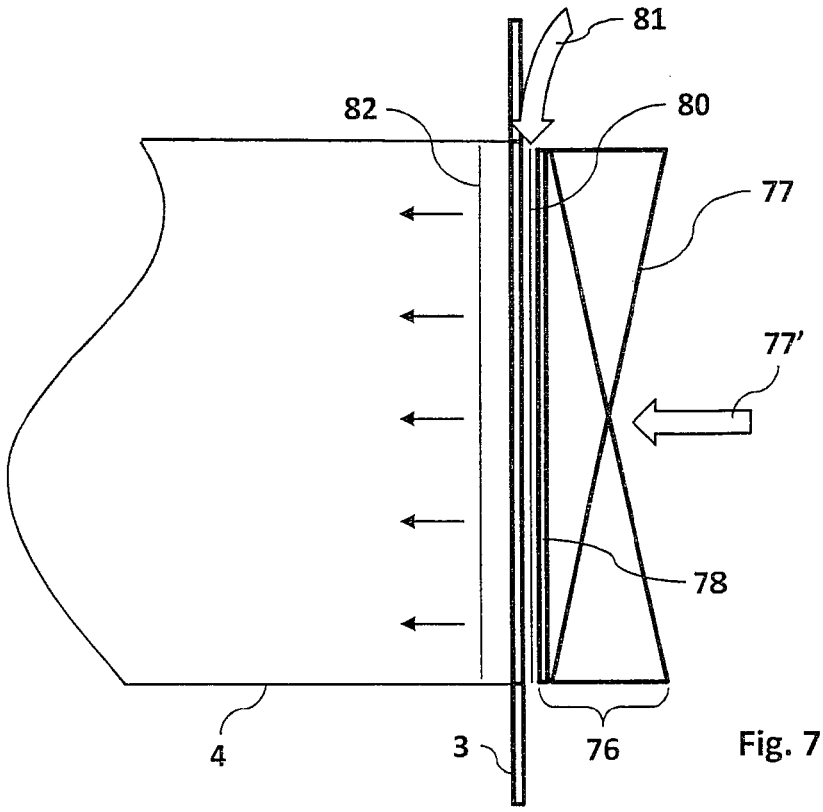
FIG. 7 is a partial sectional side elevation view of a secure banknote carrier receiving a banknote from a pusher plate arrangement.

As shown in the partial side elevation view of FIG. 7, the stacker mechanism 69 comprises a pusher plate arrangement 76 that includes a scissors mechanism 77 operably connected to a plate member 78. In operation, a banknote is transported 81 by a banknote transport drive 74 to a stacking position 80. Operation of the scissors mechanism 77 in a direction indicated by arrow 77' in turn pushes the banknote from position 80 through a banknote aperture 8 in the articulated bi-fold frame 3 to position 82 at the top of the banknote stack 68 within the bag 4.

Removal of a banknote cassette 60 from a cassette docking station 70 will now be described with reference to FIGS. 8A to 9B.

Although not shown in the Figures, it should be noted that in operation the banknote cassette 60 is secured within the cassette docking station 70 via a locking mechanism that can only be unlocked by an authorised user.

From the position shown in FIG. 4C, a user withdraws the banknote cassette 60 from the cassette docking station 70 by pulling on the handle 61. As the banknote cassette 60 is retracted from the docking station 70 radially outer ends of the resiliently biased gate members 72 engage with the engagement channels 11 of the articulated bi-fold frame 3.

Figure 8A:
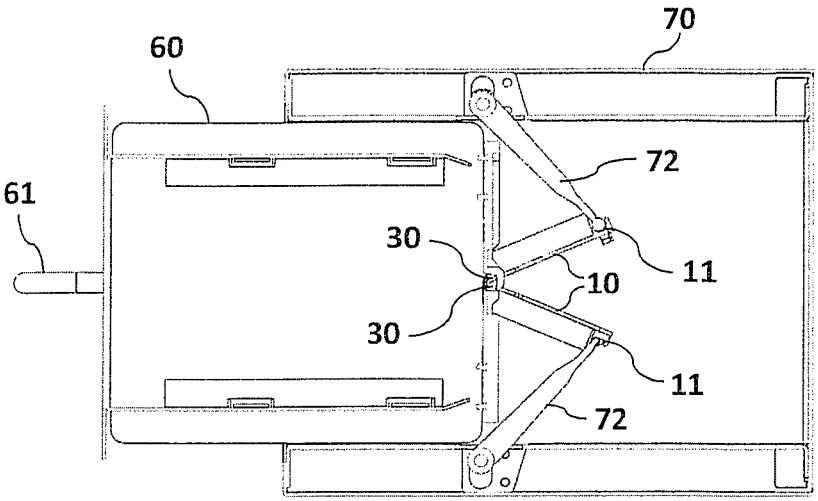
FIGS. 8A to 8C show sectional plan views of a banknote cassette of the present invention at various stages of retraction from the cassette docking station.

As the banknote cassette 60 is further retracted from the cassette docking station 70, the gate members 72 resile inwardly whilst in continuous engagement with the engagement channels 11 such that jaw members 10 of the articulated bi-fold frame 3 are rotated towards one another as shown in FIGS. 8A and 9A.

Figure 8B:
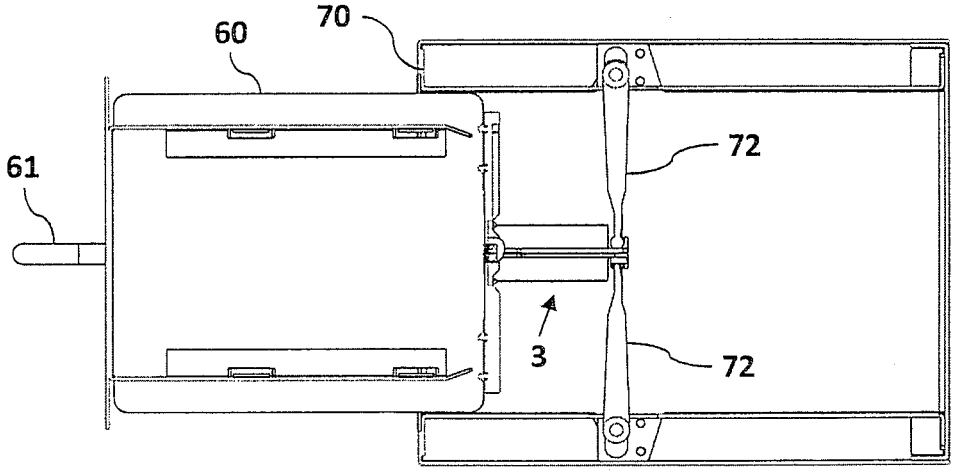

As shown in FIGS. 8B and 9B, further retraction of the banknote cassette 60 from the cassette docking station 70 brings the pair of jaw members 10 into a fully closed position such that the locking means 16 is fully and irreversibly engaged through the interlocking of male barb means 18 and female engaging means 20.

Figure 8C:
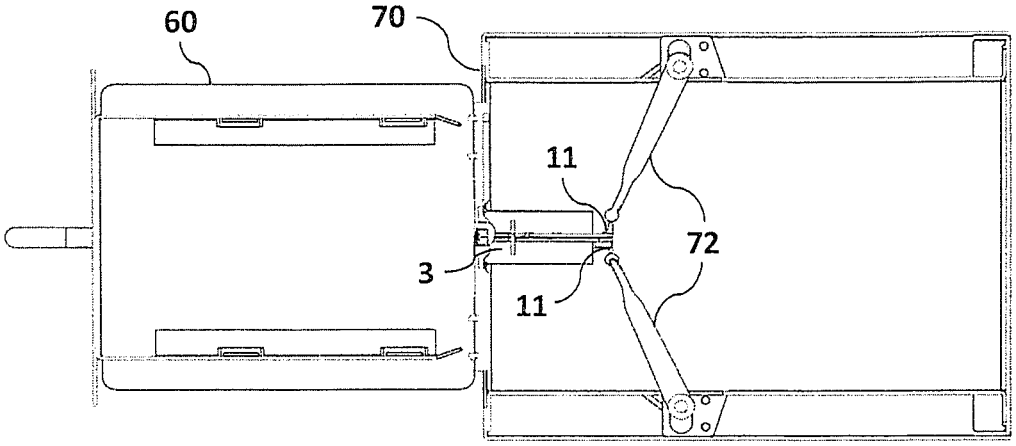

As shown in FIG. 8C, in a final stage of a retraction operation, radially outer ends of the resiliently biased gate members 72 disengage from the engagement channels 11 thereby releasing the articulated bi-fold frame 3 from connection with the cassette docking station 70. From this position it is possible for an authorised user to fully remove the banknote cassette 60 from the cassette docking station 70 and subsequently release and remove the now secured banknote carrier 1 from the banknote cassette 60.

Although not shown in the Figures, the banknote handling apparatus 50 includes a plurality of sensors for monitoring the operation of the apparatus. Typically, the sensors will be optical sensors disposed proximal to the resiliently biased gate members 72 to provide signals indicative of when the gate members are in a fully open position (FIG. 4C) and a fully closed position (FIG. 8C). In addition, sensors are included within the stacker mechanism 69 to provide signals indicative of the banknote position 80 and the position of the plate member 78 (see FIG. 7). Furthermore, and as noted above, barcode readers and/or RFID tag sensors can also be deployed where appropriate to identify and monitor the presence of a securable banknote carrier within the banknote cassette.

Sensors are also disposed within the banknote cassette 60 to provide a dynamic indication of the position of the pusher plate 66, and the cassette docking station 70 includes a barcode scanner for reading the barcode affixed to the identifying indicia mount 28. Advantageously, the sensors monitoring the pusher plate position also provide an indication of when the securable banknote carrier 1 is full.

FIGS. 11A and 11B show a banknote validation and bagging system 100 incorporating the banknote handling apparatus 50 of the present invention.

The banknote validation and bagging system 100 includes a banknote validator 90 having a banknote insertion slot 91 for receiving banknotes. Received and verified banknotes are transported 73' to the banknote handling apparatus 50 to be stored within a securable banknote carrier 1 (not shown) held within the banknote cassette 60. In FIG. 11A the banknote cassette 60 is shown in a partially withdrawn position, and in FIG. 11B the banknote cassette 60 is shown in a fully received position within the cassette docking station 70.

The invention claimed is:

1. A securable banknote carrier comprising an enclosure of flexible material attached to an articulated bi-fold frame delimiting a banknote aperture, wherein the frame comprises a pair of hingedly coupled opposing jaw members, and wherein the frame is configured such that when moving from a banknote aperture open position to a banknote aperture closed position the opposing jaw members rotate inwardly towards one another from a position in which the jaw members are substantially coplanar to a position in which the jaw members are substantially adjacent and parallel to each other; and wherein the articulated bi-fold frame includes locking means for irreversibly locking the opposing jaw members together in the banknote aperture closed position.

2. The securable banknote carrier as claimed in claim 1, wherein the opposing jaw members are coupled together via a pair of live hinges.

3. The securable banknote carrier as claimed in claim 2, wherein the opposing jaw members rotate about a common axis that passes through each of the pair of live hinges, and said live hinges provide a small bias in favor of folding of the articulated bi-fold frame.

4. The securable banknote carrier as claimed in claim 1, wherein the locking means comprises at least one male barb disposed on one of the pair of opposing jaw members and at least one corresponding female device disposed on the other jaw member and adapted to receive the at least one male barb, wherein once mated the male barb and the female device cannot be disengaged without destruction or rupture of one of the male barb or the female device.

5. The securable banknote carrier as claimed in claim 1, wherein each of the jaw members includes a skirt portion projecting substantially orthogonally from an underside surface thereof, and wherein the enclosure of flexible material is attached to each skirt portion.

6. The securable banknote carrier as claimed in claim 5, wherein the enclosure of flexible material comprises a foldable or compressible bag.

7. The securable banknote carrier as claimed in claim 6, wherein the foldable or compressible bag is permeable to ink or dye.

8. A banknote cassette for removable insertion into a banknote handling apparatus comprising:

a securable banknote carrier including an enclosure of flexible material attached to an articulated bi-fold frame delimiting a banknote aperture, wherein the frame comprises a pair of hingedly coupled opposing jaw members, and wherein the frame is configured such that when moving from a banknote aperture open position to a banknote aperture closed position the opposing jaw members rotate inwardly towards one another from a position in which the jaw members are substantially coplanar to a position in which the jaw members are substantially adjacent and parallel to each other;

a casing defining outer walls and a aperture for receiving the securable banknote carrier;

at least one mounting bracket adapted to releasably receive at least one corresponding lug disposed on the securable banknote carrier; and a resiliently biased stacker plate disposed opposite said aperture.

9. A banknote cassette as claimed in claim 8, and wherein in operation the resiliently biased stacker plate is urged against expansion of the enclosure of flexible material.

10. The banknote handling apparatus comprising:

the banknote cassette as claimed in claim 8 removably housed within a cassette docking station configured to receive banknotes, the cassette docking station including a banknote stacker mechanism for sequentially feeding received banknotes into the securable banknote carrier held within the banknote cassette; and a pair of gate members adapted to engage with the securable banknote carrier upon insertion of the banknote cassette.

11. The banknote handling apparatus as claimed in claim 10, wherein each of the pair of gate members is resiliently biased in a substantially closed position.

12. The banknote handling apparatus as claimed in claim 11, wherein the gate members are interconnected such that each of the pair of gate members is configured to open and close in unison with the other.

13. The banknote handling apparatus as claimed in claim 12, wherein said opposing jaw members have laterally disposed channels and wherein insertion of the banknote cassette containing the banknote carrier into the cassette docking station urges the pair of gate members inwardly away from the advancing banknote cassette into a substantially open position, and wherein upon retraction of the banknote cassette said gate members initially resile to cooperatively engage with the laterally disposed channels of the opposing jaw members and, upon further retraction of the banknote cassette, continue to resile to a closed position simultaneously folding the bi-fold frame into the banknote aperture closed position such that opposing jaw members interlock via action of a locking means.

* * * * *